US008267162B1

(12) United States Patent
Pinto

(10) Patent No.: US 8,267,162 B1
(45) Date of Patent: Sep. 18, 2012

(54) BI-DIRECTIONAL PRESSURE RELIEF VALVE FOR A PLATE FIN HEAT EXCHANGER

(75) Inventor: Archibald E Pinto, Fontana, CA (US)

(73) Assignee: Standard Motor Products, Long Island City, NY (US)

( * ) Notice: Subject to any disclaimer, the term of this patent is extended or adjusted under 35 U.S.C. 154(b) by 559 days.

(21) Appl. No.: 12/211,463

(22) Filed: Sep. 16, 2008

(51) Int. Cl.
*F28F 9/02* (2006.01)

(52) U.S. Cl. ..... 165/174; 165/281; 137/269.5; 137/493.8; 137/512.4; 137/515.7; 137/855; 251/12; 251/73; 251/175; 251/178; 251/302; 251/361

(58) Field of Classification Search ..... 165/172–176, 165/151–153, 165–167, 281, DIG. 92, DIG. 100, 165/DIG. 101, DIG. 104, DIG. 109, DIG. 113, 165/DIG. 123; 137/493.8, 512.15, 512.4, 137/269.5, 493, 493.7, 493.9, 512.5, 515.7, 137/843, 845, 851, 852, 855; 138/171; 251/12, 251/66, 73, 142, 149.9, 148, 150, 152, 143, 251/175–178, 298, 301–303, 336, 358, 361
See application file for complete search history.

(56) References Cited

U.S. PATENT DOCUMENTS

| | | | | | |
|---|---|---|---|---|---|
| 90,322 | A | * | 5/1869 | Vanstone | 228/173.6 |
| 1,416,771 | A | * | 5/1922 | Babson et al. | 137/512.4 |
| 2,101,311 | A | * | 12/1937 | Duncan | 285/288.1 |
| 2,666,981 | A | * | 1/1954 | Sandberg | 29/890.038 |
| 3,106,219 | A | * | 10/1963 | Teston | 137/510 |
| 3,565,099 | A | * | 2/1971 | Huber | 137/269.5 |
| 3,877,514 | A | * | 4/1975 | Beck | 165/286 |
| 4,231,394 | A | * | 11/1980 | Hrabal et al. | 137/512 |
| 4,253,491 | A | * | 3/1981 | Worthen et al. | 137/601.2 |
| 4,317,467 | A | * | 3/1982 | Heyland | 137/493 |
| 4,353,243 | A | * | 10/1982 | Martin | 73/23.42 |
| 4,437,490 | A | * | 3/1984 | Demers et al. | 137/512.4 |
| 4,954,252 | A | * | 9/1990 | Griffin et al. | 210/136 |
| 4,991,643 | A | * | 2/1991 | Price et al. | 165/283 |
| 5,016,669 | A | * | 5/1991 | Jamieson | 137/512 |
| 5,695,004 | A | * | 12/1997 | Beckwith | 165/104.21 |
| 5,706,670 | A | * | 1/1998 | Voorhis | 62/324.6 |
| 5,715,862 | A | * | 2/1998 | Palmer | 137/493.8 |
| 5,794,654 | A | * | 8/1998 | Marvonek et al. | 137/512.15 |
| 5,826,649 | A | * | 10/1998 | Chapp et al. | 165/174 |
| 5,836,349 | A | * | 11/1998 | Kimberly et al. | 137/493.8 |
| 6,070,657 | A | * | 6/2000 | Kunkel | 165/158 |
| 6,167,956 | B1 | | 1/2001 | Bostedo et al. | |
| 6,220,340 | B1 | | 4/2001 | Cheong et al. | |
| 6,478,080 | B2 | * | 11/2002 | Pinto | 165/153 |
| 6,923,251 | B2 | * | 8/2005 | Higashiyama | 165/153 |
| 6,932,110 | B2 | * | 8/2005 | Mijers | 137/512.4 |
| 7,222,641 | B2 | | 5/2007 | Peric | |
| 7,231,962 | B2 | | 6/2007 | Han | |
| 7,318,451 | B2 | | 1/2008 | Peric et al. | |

(Continued)

*Primary Examiner* — Ljiljana Ciric
*Assistant Examiner* — Thomas Y Ho
(74) *Attorney, Agent, or Firm* — Kelley, Drye & Warren LLP

(57) ABSTRACT

A bi-directional pressure relief valve for a plate fin heat exchanger including an elongated heat exchanger tube having ends and a channel for the flow of a fluid from one end of the tube to the opposite end and a bi-directional reed valve positioned within the channel. The reed valve allows fluid to flow within the channel in either direction when a pressure differential across the reed valve is sufficient to urge the reed valve to an open position, thereby enabling the heat exchanger to be used independent of the direction of fluid flow through the heat exchanger.

19 Claims, 6 Drawing Sheets

U.S. PATENT DOCUMENTS

| | | | | |
|---|---|---|---|---|
| 7,390,176 | B2 * | 6/2008 | MacBain et al. | 417/571 |
| 7,497,230 | B1 * | 3/2009 | Hawkins et al. | 137/512.4 |
| 2003/0019527 | A1 * | 1/2003 | Oppermann et al. | 137/512.15 |
| 2005/0081921 | A1 * | 4/2005 | Blake et al. | 137/512.15 |
| 2006/0032626 | A1 | 2/2006 | Keen | |
| 2006/0237185 | A1 | 10/2006 | Peric | |

* cited by examiner

BI-DIRECTIONAL PRESSURE RELIEF VALVE FOR A PLATE FIN HEAT EXCHANGER

BACKGROUND OF THE INVENTION

1. Field of the Invention

The present invention relates to a bi-directional pressure relief valve for a plate fin heat exchanger.

2. Description of Related Art

Heat exchangers in automobiles are used in heating and cooling systems and may be a radiator, heater core, oil cooler or the like. Some heat exchangers have a symmetrical structure wherein the unit is similar in the front and rear profiles. This produces a situation where the unit may be inadvertently installed in the reverse direction, sometimes providing heat exchange equally well in either direction. A problem arises when the symmetrical heat exchanger has an internal component affected by direction of fluid flow. A pressure relief valve, for example, is used to bypass at least a portion of the fluid flowing to prevent pressure buildup in the heat exchanger. Pressure relief valves are required when the fluid, especially viscous fluids are at or below operating temperatures, such as operating in cold weather conditions. The high viscosity of the fluid creates additional resistance to fluid flow, thereby restricting the flow rate of the fluid. The relief valve is also required whenever the heating or cooling system may be susceptible to pressure spikes.

Pressure relieve valves are used to reduce the restriction (pressure drop) to fluid flow through the heat exchanger. They additionally protect the heat exchanger and the heating or cooling system from pressure impulses (spikes). Pressure relief valves allow bypass in only one direction, allowing no flow in the opposite direction. If the pressure relief valve is installed in a heat exchanger system which has been installed with the flow direction opposite the intended direction, the pressure relief valve will block flow while conditions indicate the relief valve should be in apartially or fully open state. This creates a condition which may cause damage to other components of the heating or cooling system as well as create a safety concern.

SUMMARY OF THE INVENTION

Bearing in mind the problems and deficiencies of the prior art, it is therefore an object of the present invention to provide a bi-directional pressure relief valve for a plate fin heat exchanger which allows proper bypass of fluid when required in either flow direction.

It is another object of the present invention to provide an economical bi-directional pressure relief valve which is easily implemented in a plate fin heat exchanger.

A further object of the invention is to provide a bi-directional pressure relief valve for a plate fin heat exchanger which prevents excess pressure buildup.

It is yet another object of the present invention to provide a bi-directional pressure relief valve for a plate fin heat exchanger for use in automotive heating or cooling system.

Still other objects and advantages of the invention will in part be obvious and will in part be apparent from the specification.

The above and other objects, which will be apparent to those skilled in the art, are achieved in the present invention which is directed to a bi-directional pressure relief valve for a plate fin heat exchanger comprising an elongated heat exchanger tube having ends and a channel for the flow of a fluid from one end of the tube to the opposite end and a bi-directional reed valve positioned within the channel. The reed valve allows fluid to flow within the channel in either direction when a pressure drop across the reed valve is sufficient to urge the reed valve to a partial or fully open position.

In one aspect of the bi-directional pressure relief valve, the reed valve includes two deformable sections, each section independently movable to an open position by fluid pressure. The first deformable section is movable by pressure caused by fluid flow in one direction and the second deformable section is movable by pressure caused by fluid flow in the opposite direction.

In another aspect of the bi-directional pressure relief valve, the reed may include one deformable section, capable of moving in either direction of its main axis to an open position by fluid pressure.

The elongated heat exchanger tube may be a pair of opposing elongated plates each having edges along the perimeter, the corresponding edges brazed for sealing the opposing plates whereby a tube or conduit is produced by the opposing plates, the opposing plates preferably having grooves (channels for fluid flow) along the length.

The reed valve may be a metal strip having opposing tongues extending away from the central axis of metal strip and adapted to swing from the plane of the metal strip when a fluid pressure urges the first or second tongue to a position outward of the plane of the metal strip. Fluid is allowed to flow past the first or second tongue when sufficient pressure is exerted on the tongue in the direction allowable by the structure of the relief valve.

In another aspect of the bi-directional pressure relief valve the elongated heat exchanger tube includes a pair of opposing elongated plates, each plate having a width, a length greater than the width and an edge along the perimeter. The elongated plates include a first opening at one end, a second opening at the opposite end, a first groove along the plate length extending from the first opening to a pocket intermediate the plate length and a second groove along the plate length extending from the second opening toward the pocket and not communicating with the pocket.

The bi-directional reed valve is positioned between the first plate and the second plate and may be a metal strip having opposing tongues adapted to swing from the plane of the metal strip when a fluid pressure urges the first or second tongue to a bent position. Opposing plates in the plate pair are sealingly attached along corresponding perimeters, the first groove of one plate adjacent the second groove of the opposite plate and forming a conduit for fluid to flow. The pocket of one plate is adjacent the pocket of the opposing plate whereby the fluid is allowed to flow past the first or second tongue when sufficient pressure is exerted on the tongue. In the preferred embodiment of the elongated plates, the first and second grooves may each be a pair of adjacent elongated depressions in the plate.

In another aspect, the present invention may be directed to a heat exchanger with integral bi-directional pressure relief valve comprising a plurality of parallel elongated fin plates having plate openings at each end, fins between the fin plates and at least one bi-directional pressure relief valve. The pressure relief valve has an elongated heat exchanger tube with ends and a channel for the flow of a fluid from tube openings at one end of the tube to tube openings at the opposite end, the tube openings corresponding with the plate openings. The pressure relief valve includes a bi-directional reed valve positioned within the channel whereby the reed valve allows fluid to flow within the channel in either direction when a pressure drop across the reed valve is sufficient to urge the reed valve to a partial or fully open position.

The pressure relief valve may also include a first valve opening at one end of the elongated plate and a second valve opening at the opposite end. The relief valve may additionally include a first groove along the plate length extending from the first opening to a pocket about centered between the plate ends and a second groove along the plate length extending from the second opening near but not converging with the pocket.

The bi-directional reed valve between the first plate and the second plate may be a metal strip having a width and a length greater than the width, a first tongue and opposing second tongue adapted to swing from the plane of the metal strip when a fluid pressure urges the first or second tongue to deform. The plates in the plate pair are sealingly attached along corresponding perimeters, the first groove of one plate adjacent the second groove of the opposite plate and forming a conduit for fluid to flow and the pocket of one plate substantially lining adjacent the pocket of the opposing plate. The fluid is allowed to flow past the first or second tongue when sufficient pressure is exerted on the tongue.

In one aspect of the relief valve according to the present invention, the reed valve comprises a rectangular sheet metal element that is stamped from elastic materials and has the ability to retain its original state once a load has been removed. Typical materials are higher alloy steels such as spring steel or stainless steel grades. The rectangular sheet metal element has a flap that is machined, laser cut—fine blanked or chemically milled and can include a variety of profiles to adapt to design requirements. The material properties, material thickness and the geometry of the flap determines the flow characteristics such as the cracking pressure and flow rates (resistance and flow coefficients). The reed valve may include single or dual flaps and the channels may comprise single or multiple longitudinal passages.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-13 of the drawings in which like numerals refer to like features of the invention.

Figure 1:
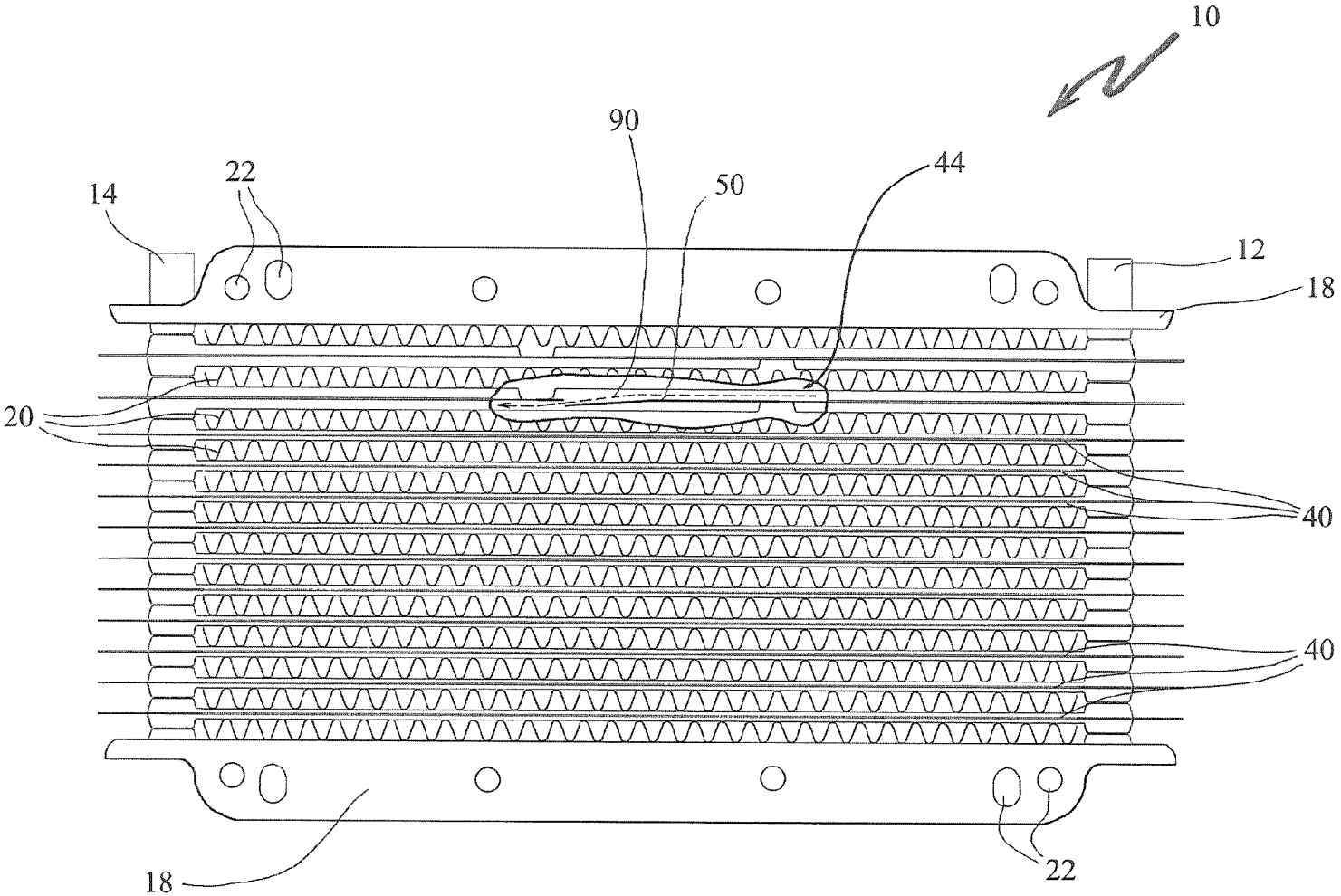
FIG. 1 is a front elevational view of a plate fin heat exchanger with a cutaway view of a bi-directional pressure relief valve according to the present invention.

A heat exchanger 10, shown in FIG. 1 with a cutaway view of a bi-directional pressure relief valve 44, consists of heat exchange tubes 40, fins 20 between the plates and the bi-directional pressure relief valves 44. The heat exchanger includes a fluid inlet 12 and a fluid outlet 14 for connection within a heat exchange system. The heat exchange system, for example, may be an automotive oil cooling system. A pair of opposing frame members 18 are used for mounting the heat exchanger using the fastener openings 22 as well as for providing a protective frame for increasing structural integrity to the heat exchanger.

Figure 2:
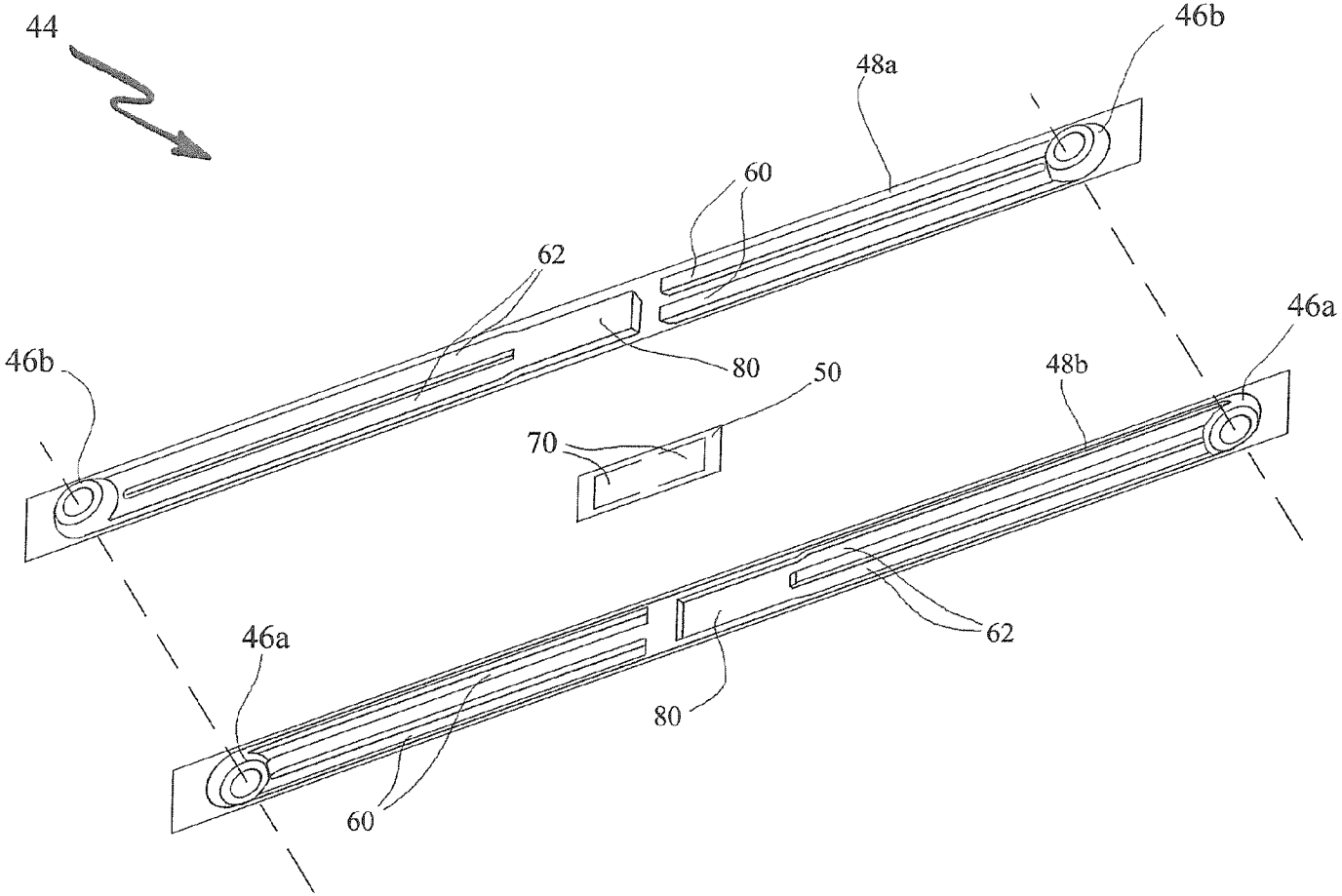
FIG. 2 is an exploded perspective view of the bi-directional pressure relief valve according to the present invention
Figure 3A:
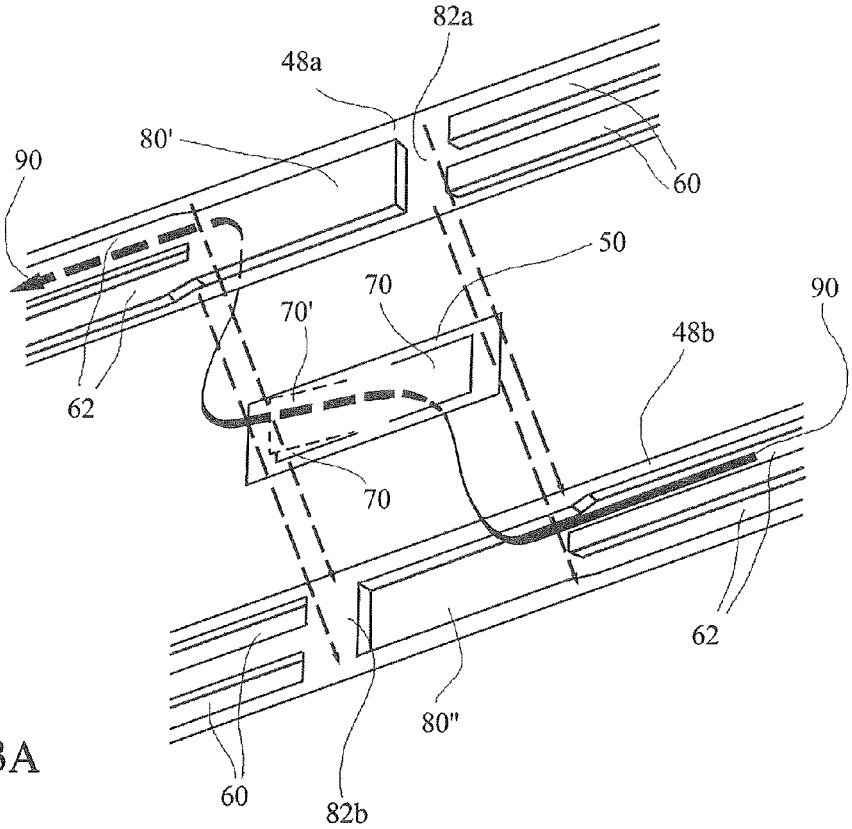
FIG. 3A is an enlarged exploded perspective view of a portion of the bi-directional pressure relief valve showing alignment of the reed valve according to the present invention.

As shown in the exploded view of the bi-directional pressure relief valve 44 in FIGS. 2 and 3, a bi-directional reed valve 50 is positioned between a pair of elongated opposing valve assembly plates 48*a*, 48*b*, each plate having a raised opening 46*a*, 46*b* at each plate end. The valve plates may be brazed or otherwise sealed along the corresponding perimeters. A first groove 60 extends from the plate opening 46*a* and terminating at the reed valve edge. A second groove 62 extends from opening 46*b* to a plate pocket 80 adjacent to the surface of the reed valve. In the preferred embodiment, the groove 60 is a pair of adjacent grooves, the surface between the grooves providing structural integrity to the bi-directional valve assembly as well as additional surface area for heat exchange. Each of the valve assembly plates in the pair are positioned such that the first groove 60 is adjacent the second groove 62 of the opposing plate, resulting in channels on either side of the reed valve for fluid flow. The pocket 80 is about centered along the plate 48*a*, 48*b* length so that the pocket 80 of opposing plates lie on either side of the reed valve 50.

The heat exchanger tubes 40, often called heat exchanger plates, through which the fluid passes have apertures on each end brazed or otherwise connected with a relief valve plate 48 or to one another to form a manifold on each end of the valve plates and the heat exchange tubes.

Figure 3B:
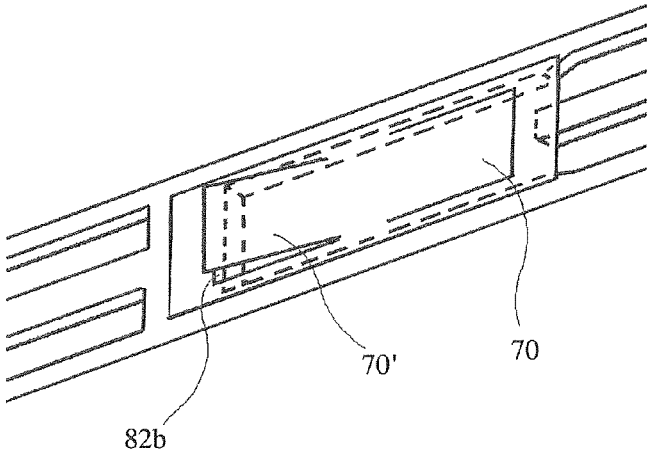
FIG. 3B is an enlarged view of the bi-directional reed valve showing tongue deflection away from the flow barrier.
Figure 4:
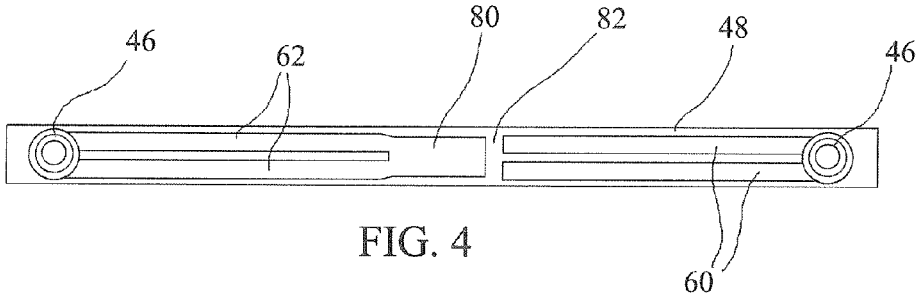
FIG. 4 is a top plan view of the bi-directional pressure relief valve according to the present invention.
Figure 5:
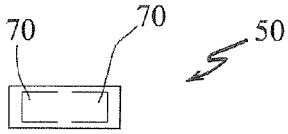
FIG. 5 is a top plan view of the reed valve according to the present invention.
Figure 6:
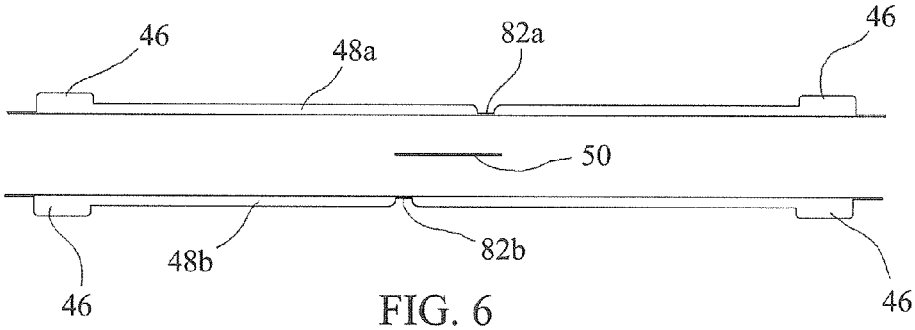
FIG. 6 is a front elevational view of the exploded bi-directional pressure relief valve in a fluid channel according to the present invention.
Figure 7:
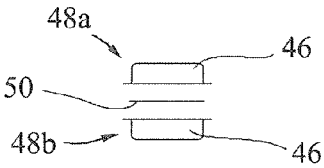
FIG. 7 is a side elevational view of the exploded bi-directional pressure relief valve according to the present invention.

A top plan view of the elongated plate and the bi-directional reed valve in FIGS. 4-5 show the layout of the grooves 60, 62 wherein a flow barrier 82 separates groove 60 and the pocket 80. The flow barrier prevents fluid flow between groove 60 and pocket 80 of the elongated plate. The reed valve however, does allow fluid flow between groove 60 of elongated plate 48*a* and the pocket of the opposing elongated plate 48*b* when a fluid pressure urges deformation of the reed valve tongue. As shown in FIG. 3B, one surface of the reed valve lies sealingly against the flow barrier 82*b* of plate 48*b* with the deflected tongue 70' overlapping the barrier 82*b* so that the tongue 70' may deflect in a direction away from the barrier 82*b* but not in a direction toward the barrier. Similarly, the opposing tongue 70 may deflect in the opposite direction away from barrier 82*a*, but not toward barrier 82*a*. This configuration allows pressure relief by tongue 70' with fluid flow in one direction and pressure relief by tongue 70 with fluid flow in the opposite direction. The raised openings 46 have a depth D greater than the groove depth d, allowing space between grooves of adjacent heat exchange tubes and of other relief valve tubes to accommodate heat exchanger fins, shown assembled in FIG. 1.

The reed valve 50 is a flat metal strip having a width and a length greater than the width. As shown in FIG. 3, the reed valve includes opposing tongues or flaps having a hinged portion and a movable portion which swings from its normal position 70 with the strip to a stressed position 70' away from the normal position. The tongue extends lengthwise toward the strip end. The stressed position is caused by a pressure against the tongue sufficient to swing the tongue in the direction of flow 90 from pocket 80" to pocket 80'. The degree of swing is proportional to the amount of pressure caused by the fluid flow. Subsequently, the faster the flow, the greater the pressure is and the greater the tongue swing, resulting in a valve that allows increased bypass as the pressure increases. The only fluid which may pass from one side of the reed valve to the other when the reed valve is in the normal position is a trickle flowing through a gap between the reed surface and the reed tongue or flap. The trickle may provide additional heat exchange through the valve assemble since the opposing plates contact the fins, allowing heat exchange between the trickling fluid and the air flowing across the fins. In the preferred embodiment of the bi-directional pressure relief valve, each of the opposing tongues is movable in a direction away from the plane of the strip only in one direction, each in a direction opposite the other. The swing of the tongue may be deformation of the tongue whereby the tongue is urged to an arcuate bend or may be a flat swinging movement of the tongue in a flat posture.

The flow arrow in FIG. 3 shows the fluid flow path when a fluid pressure has increased on one side of the reed valve 50 sufficient to urge the tongue 70 to a position tongue position 70' indicated by phantom lines. The space created by the tongue movement allows fluid flow from one pocket 80" to the opposing pocket 80'. The bi-directional reed valve is preferably made from spring steel.

In operation, according to the heat exchanger of the present invention and referring back to FIG. 1, the fluid flows in through the inlet port 12 and into the corresponding inlet side manifold, through the heat exchange tubes 40 to the outlet side manifold and exiting the heat exchanger through the outlet port 14. When the flow of fluid through the heat exchange tubes is not impeded causing little pressure drop across the tubes, the reed valve as shown in FIG. 2 does not open to allow fluid to flow. An increase in fluid viscosity, an increase in flow velocity, additional resistance to flow or a combination of parameter changes will increase the pressure drop across the heat exchange tubes, and therefore the pressure relief valve, forcing the tongue 70 to a position 70' as shown in FIG. 3, by the pressure differential across the reed valve.

In the preferred embodiment, the inlet port and outlet port may be reversed since the bi-directional pressure relief valves 48 of the heat exchanger are substantially symmetrical and control fluid flow in either direction.

Figure 8:
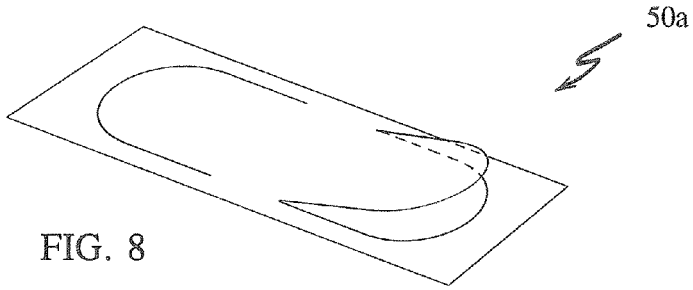
FIG. 8 is a perspective view of second embodiment of the bi-directional reed valve according to the present invention.
Figure 9:
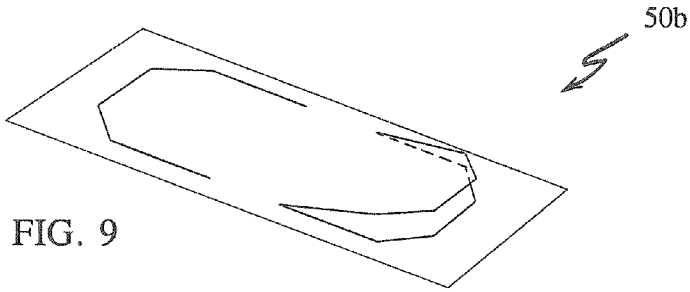
FIG. 9 is a perspective view of third embodiment of the bi-directional reed valve according to the present invention.
Figure 10:
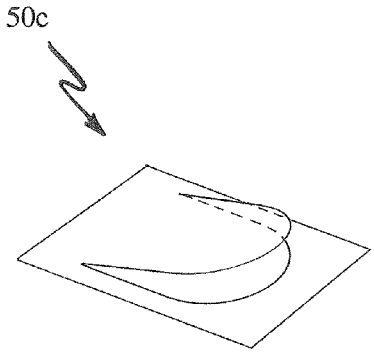
FIG. 10 is a perspective view of a single tongue reed valve according to the present invention.
Figure 11:
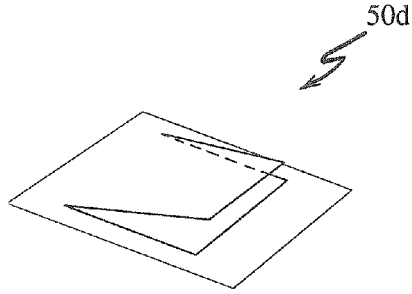
FIG. 11 is a perspective view of a second embodiment of the single tongue reed valve according to the present invention.
Figure 12:
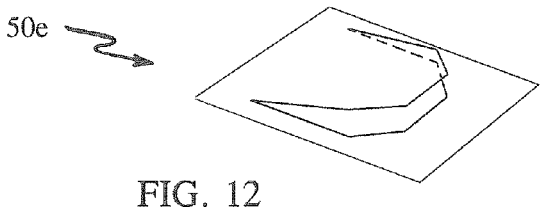
FIG. 12 is a perspective view of a third embodiment of the single tongue reed valve according to the present invention.

In alternate embodiments of the reed valve, FIGS. 8 and 9 show that the tongue of the bi-directional reed valve 50*a*, 50*b* may be semicircular in shape or may have chamfered ends. Additionally, as shown in FIGS. 10-12, the reed valve 50*c*, 50*d*, 50*e* may have a single tongue wherein the tongue may deflect in either direction.

Figure 13:
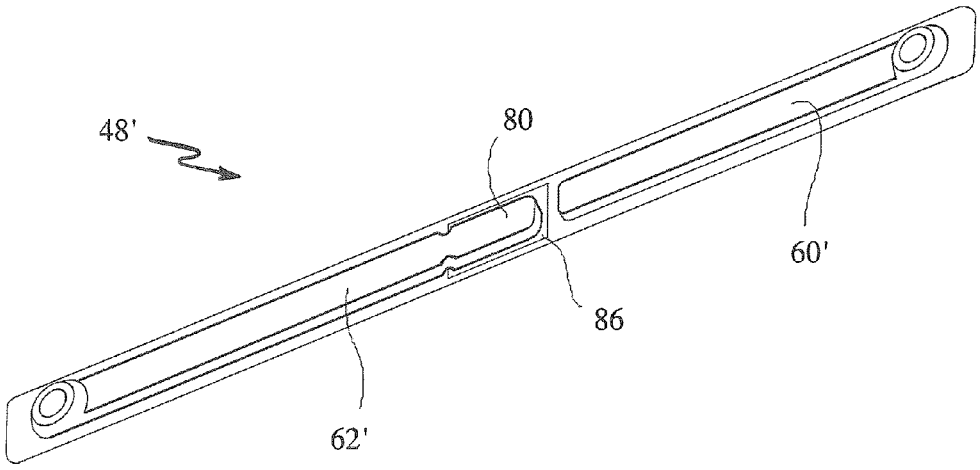
FIG. 13 is a perspective view of a stamped plate element according to the present invention.

In manufacturing of the pressure relief valve, a flat metal strip may be stamped to produce the plate element 48' of FIG. 13, including grooves 60', 62', a pocket 80 and an indentation 86 to accommodate the reed valve. The embodiment of FIG. 13 includes grooves 60', 62' formed without additional structure within the groove.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A bi-directional pressure relief valve comprising:

an elongated heat exchanger tube having ends and a channel for the flow of a fluid from one end of the tube to the opposite end, the elongated heat exchanger tube comprising a pair of opposing elongated plates each having a first groove extending from an inlet opening on a first end of the said elongated plate to a pocket centrally located lengthwise along the elongated plate and a second groove extending from an outlet opening on a second end opposite the first end of said elongated plate to a barrier adjacent to the pocket, wherein said ends of said heat exchanger tube constitute portions of an input and an output manifold respectively; and a flat metal strip having two deformable sections, each section independently movable to an open position by fluid pressure thereagainst, said flat strip including an outer perimeter surrounding said deformable sections, and said flat metal strip positioned in a plane parallel to a lengthwise plane of said opposing elongated plates within said channel and secured in place by said pair of elongated plates;

whereby said flat metal strip allows said fluid to flow within said channel in either direction when said pressure differential is sufficient to urge one of said deformable sections to said open position but substantially prevents the flow of said fluid between said ends of said heat exchanger tube when a pressure differential across said flat metal strip is insufficient to urge one of said deformable sections to an open position.

2. The bi-directional pressure relief valve in accordance with claim 1 wherein said first deformable section is movable by pressure caused by fluid flow in one direction and said second deformable section is movable by pressure caused by fluid flow in the opposite direction.

3. The bi-directional pressure relief valve in accordance with claim 1 wherein said pair of opposing elongated plates each has edges along the perimeter thereof, the corresponding edges sealingly brazed.

4. The bi-directional pressure relief valve in accordance with claim 1 whereby fluid is allowed to flow past the one of said deformable sections when sufficient pressure is exerted on one of said deformable sections.

5. The bi-directional pressure relief valve in accordance with claim 1 wherein said opposing elongated plates are sealingly attached along corresponding perimeters, said first groove of one of said opposing elongated plates adjacent along said corresponding perimeters, and adjacent to said second groove of the opposite plate and forming a conduit for said fluid to flow and the pocket of one of said opposing elongated plates adjacent to the pocket of the opposing plate and whereby said fluid is allowed to flow past the one of said deformable sections when sufficient pressure is exerted on said deformable section.

6. The bi-directional pressure relief valve in accordance with claim 1 wherein said first and said second groves are each a pair of adjacent elongated depressions in each of said opposing elongated plates.

7. A heat exchanger comprising:

a plurality of parallel elongated heat exchange tubes and fins between the tubes, each tube having tube openings at each end thereof, wherein said tube openings constitute portions of an input and an output manifold respectively;

at least one bi-directional pressure relief valve comprising:

a pair of elongated valve plates, the pair of plates having ends and a channel for the flow of a fluid from one end of said pair of elongated valve plates to the opposite end, each plate having a first groove extending from an inlet opening on a first end of said elongated plate to a pocket centrally located lengthwise along said elongated plate and a second groove extending from an outlet opening on a second end opposite the first end of the elongated plate to a barrier adjacent to the pocket; and a bi-directional reed valve positioned within said channel in a plane parallel to a lengthwise plane of said opposing elongated plates, said reed valve comprising a flat strip having two deformable sections, each of said sections independently movable to an open position by fluid pressure thereagainst, said flat strip including an outer perimeter surrounding said deformable sections and secured in place by said pair of elongated valve plates, whereby said bi-directional reed valve controls said flow of fluid from one end of said pair of elongated valve plates to the opposite end.

8. The bi-directional pressure relief valve in accordance with claim 1 including a first barrier adjacent to one of said pockets and a second barrier adjacent to the other of said pockets wherein each of said deformable sections lies sealingly against one of said flow barriers when there is no fluid flowing through said relief valve.

9. The bi-directional pressure relief valve in accordance with claim 7 wherein each deformable section overlaps said corresponding barrier so that the deformable section may deflect in a direction away from said barrier but not in a direction toward said barrier.

10. A bi-directional pressure relief valve comprising:

an elongated heat exchanger tube comprising first and second elongated plates each having first and second openings at opposite ends along a length of each plate, the first opening of each plate connected to a first groove of each plate that opens into a pocket of each plate, the second opening of each plate connected to a second groove of each plate that contacts a raised barrier portion of each plate that separates the pocket of each plate from the second groove of each plate, each pocket residing at the middle along the length of each plate, wherein said first and second openings constitute portions of input and output manifolds respectively;

the bi-directional reed valve secured, in a plane parallel to a lengthwise plane of said elongated plates, between the pockets of the first and second plates with a portion of the outer perimeter of the bi-directional reed valve contacting the raised barrier portions of the first and second plates;

together the first and second grooves of the first and second elongated plates provide said elongated heat exchanger tube with channels on opposite sides of the bi-directional reed valve for flow of a fluid from one end of said elongated heat exchanger tube to the opposite end thereof, whereby said bi-directional reed valve controls said flow of fluid within said channels.

11. The bi-directional pressure relief valve in accordance with claim 10 wherein the first and second elongated plates are brazed together at their corresponding perimeters.

12. The bi-directional pressure relief valve in accordance with claim 10 wherein the bi-directional reed valve comprises the flat strip having two deformable sections surrounded by the outer perimeter, each deformable section being independently movable to an open position by fluid pressure thereagainst.

13. The bi-directional pressure relief valve in accordance with claim 12 wherein the first deformable section of the bi-directional reed valve is movable by pressure caused by fluid flow in one direction and the second deformable section of the bi-directional reed valve is movable by pressure caused by fluid flow in the opposite direction.

14. The bi-directional pressure relief valve in accordance with claim 12 wherein the bi-directional reed valve is a metal strip having opposing tongues adapted to swing from the plane of the metal strip when fluid pressure urges one of said opposing tongues to a position outward from the plane of the metal strip, fluid flowing past said one of the opposing tongues when sufficient pressure is exerted thereon.

15. The bi-directional pressure relief valve in accordance with claim 10 wherein the bi-directional reed valve comprises a single deformable section that is movable in opposite directions for fluid flow.

16. The bi-directional pressure relief valve in accordance with claim 10 wherein the pockets of the first and second plates reside on opposite sides of the bi-directional reed valve.

17. The bi-directional pressure relief valve in accordance with claim 10 wherein the first opening of the first elongated plate and the second opening of the second elongated plate together form a fluid inlet opening while the second opening of the second elongated plate and the first opening of the first elongated plate form a fluid outlet opening.

18. The bi-directional pressure relief valve in accordance with claim 10 wherein the bi-directional reed valve provides the elongated heat exchanger tube as a reversible elongated heat exchanger tube.

19. The bi-directional pressure relief valve in accordance with claim 10 wherein said elongated heat exchanger tube is one of a plurality of elongated heat exchanger tubes residing within a heat exchanger, wherein ends of each of said plurality of elongated heat exchanger tubes are operatively interconnected to constitute input and output manifolds.

* * * * *